US005594196A

United States Patent [19]

Rontey et al.

[11] Patent Number: 5,594,196

[45] Date of Patent: Jan. 14, 1997

[54] SHOCK TUBE SURFACE CONNECTOR

[75] Inventors: Daniel Rontey, Woodstock; Glen C. Schallenkamp, Kingston; Margaret R. Seeger, Kingston; David Steedman, Kingston, all of N.Y.

[73] Assignee: Ireco, Inc., Salt Lake City, Utah

[21] Appl. No.: 425,859

[22] Filed: Apr. 20, 1995

[51] Int. Cl.[6] ..... C06C 5/00

[52] U.S. Cl. ..... 102/275.11; 102/275.7; 102/275.12; 102/305

[58] Field of Search ..... 102/275.11, 275.12, 102/275.4, 275.7, 305, 306, 307

[56] References Cited

U.S. PATENT DOCUMENTS

| | | | |
|---|---|---|---|
| 2,587,243 | 2/1952 | Sweetman | 102/307 |
| 3,175,491 | 3/1965 | Robertson . | |
| 3,205,818 | 9/1965 | Coulson | 102/275.11 |
| 3,878,785 | 4/1975 | Lundborg . | |
| 4,248,152 | 2/1981 | Yunan . | |
| 4,314,508 | 2/1982 | Love | 102/275.7 |
| 4,495,867 | 1/1985 | Mitchell, Jr. et al. | 102/275.4 |
| 4,714,017 | 12/1987 | Kelly et al. | 102/275.11 |
| 4,714,018 | 12/1987 | Löfgren | 102/275.7 |
| 4,722,279 | 2/1988 | Yunan | 102/275.4 |
| 4,748,858 | 5/1988 | Harder | 102/202.2 |
| 4,809,610 | 3/1989 | Florin | 102/275.12 |
| 5,171,935 | 12/1992 | Michma et al. | 102/275.7 |
| 5,182,417 | 1/1993 | Rontey et al. | 102/275.11 |
| 5,204,492 | 4/1993 | Jacob et al. | 102/275.12 |
| 5,293,821 | 3/1994 | True et al. | 102/275.12 |
| 5,299,500 | 4/1994 | Lindquist et al. | 102/275.12 |
| 5,327,835 | 7/1994 | Adams et al. | 102/275.11 |
| 5,423,263 | 6/1995 | Rontey et al. | 102/275.12 |

*Primary Examiner*—Michael J. Carone
*Assistant Examiner*—Theresa M. Wesson
*Attorney, Agent, or Firm*—Thorpe North & Western, L.L.P.

[57] ABSTRACT

A shock tube surface connector for initiating one or more shock tubes including a housing which forms an elongate cylindrical void, an ignition source extending from a position outside the housing to a position within the elongate cylinder, a static isolation cup disposed within the elongate cylinder adjacent to the ignition source, a sealer element disposed in the housing and on the opposite side of the static isolation cup as the ignition source, a metallic sleeve disposed within the elongate cylinder and parallel thereto, the sleeve encompassing a delay train charge at an end adjacent to the sealer element, an output charge adjacent the delay train charge and an airspace at an end opposite the sealer element. The length of the airspace, the curvature of the output charge, and the interior diameter of the metallic sleeve are selectable to vary the radial output and/or focal point of an explosive force created by ignition of the output charge.

28 Claims, 6 Drawing Sheets

SHOCK TUBE SURFACE CONNECTOR

BACKGROUND OF THE INVENTION

The present invention relates to a low shrapnel, directed output detonator, wherein the placement of the output charge controls the radius or focal point of the output charge's explosive force.

A delay blasting cap or delay-action detonator is an explosive charge which detonates at certain time intervals after an ignition signal has been generated. Delay detonators currently employ a variety of different ignition signal sources such as match heads, primer spots, percussion primers, and shock tubes. In the case of shock tubes, the signal is supplied to one end of a delay train charge. The delay train charge is a sequence of charges which ignites an output charge. The output charge is a primary or base charge which, in turn, detonates a series of shock tubes or a high explosive charge.

Traditionally, the output charge has been placed adjacent to the shock tubes or high explosive. This placement provides little or no control over the radius of explosion produced by the output charge. Additionally, the traditional design has a tendency to produce shrapnel, endangering people and items that are near the explosion. Thus, providing a low shrapnel, directed output shock tube surface connector is important if reliable, effective and safe blasting is to be accomplished.

SUMMARY OF THE INVENTION

It is an object of the invention to provide a shock tube surface connector in which the explosion of the output charge can be directed.

It is another object of the invention to provide a shock tube surface connector in which the explosion of the output charge causes little or no shrapnel to be discharged from the connector.

It is an additional object of the invention to control the focal point of the explosion of a shock tube surface connector's output charge.

It is a further object of the invention to control the radius of the explosion of a shock tube surface connector's output charge.

It is another object of the invention to enable an output charge with a slight concavity to produce a directed output explosion similar to that of a shaped charge.

It is an additional object of the invention to provide a shock tube surface connector such that the explosion of the output charge will initiate several shock tubes in a linear sequence along the axis of the output explosion.

The above and other objects of the invention are realized in three illustrative embodiments thereof, each of which includes a housing and a detonator assembly. The detonator assembly is positioned mostly within the housing and includes: an ignition source for producing an ignition signal, the ignition source having one end disposed within the housing and another end disposed outside the housing; a closure bushing placed along the ignition source, within the housing, to hold the ignition source in place relative to the housing; a static isolation cup disposed at the end of the ignition source located within the housing for preventing accidental ignition due to static build-up; a sealer element disposed on a side of the static isolation cup on a side opposite the ignition source for conveying the ignition signal; a delay charge disposed adjacent to the sealer element, opposite the static isolation cup, and being composed of an exothermic burning composition; an output charge disposed adjacent to the delay train charge, opposite the sealer element, and being composed of a heat-sensitive explosive composition for igniting a base charge or other shock tubes; an airspace disposed adjacent to the output charge, opposite the delay train charge; and, a rigid cylindrical sleeve which surrounds the delay train charge, the output charge and the airspace. Some embodiments of the invention also have a transition element separating the sealer element from the ignition source and composed of a material which readily ignites and, when ignited, burns at a fairly rapid and substantially stable combustion rate.

Having an airspace within the metallic sleeve between the output charge and an end of the housing allows the explosion of the output charge to be directed, thus controlling the radius or focal point of the explosion. By directing the explosion, less explosive can be used, less shrapnel is discharged from the connector during the explosion, and the explosion's force can be used to initiate several shock tubes in linear or matrix sequences.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
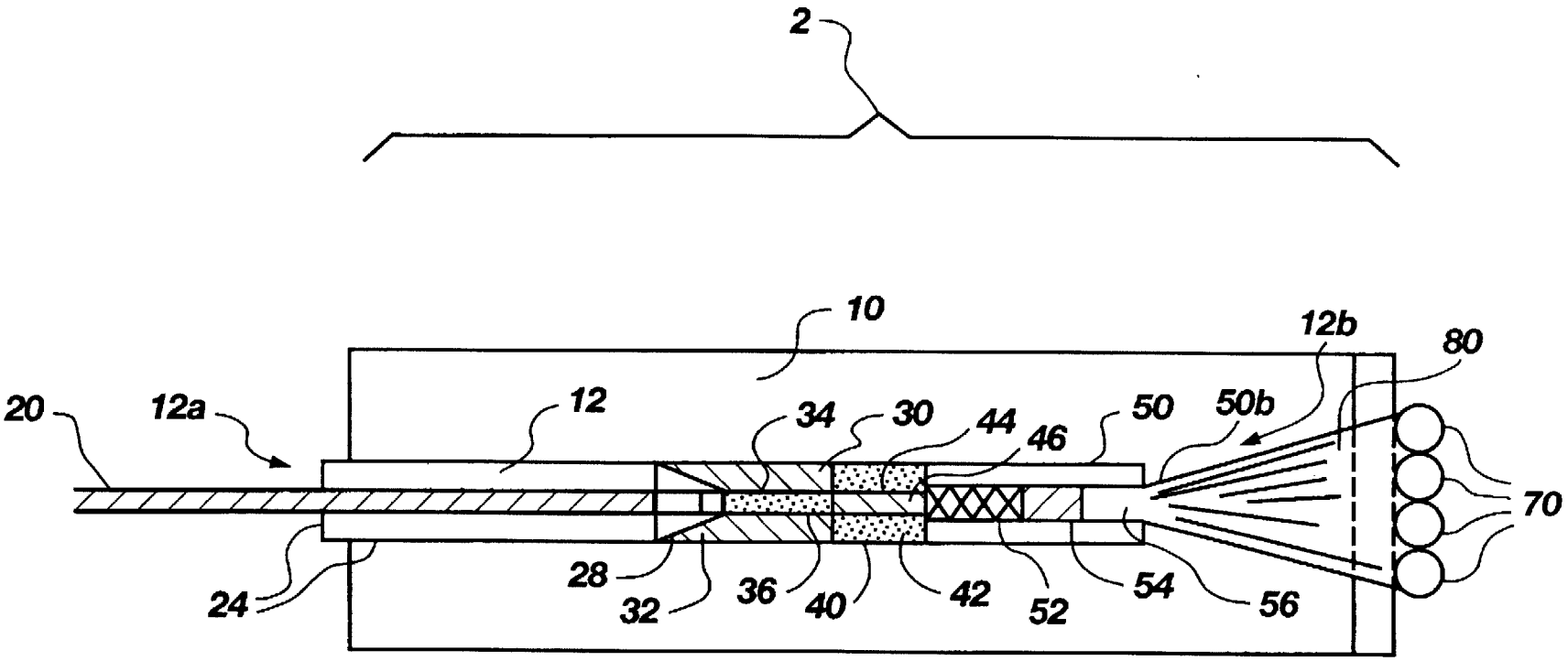
FIG. 1 shows a side cross-sectional view of a first embodiment of the shock tube surface connector.

Referring to FIG. 1, there is shown a side cross-sectional view of a first illustrative embodiment of a shock tube surface connector, generally indicated at 2, for transferring an ignition signal to multiple shock tubes, and made in accordance with the present invention. The connector 2 includes a housing 10 made of plastic or some other durable material. Within the housing 10 is formed an elongate cylindrical void 12 which is open at both ends, a first end 12*a* being open for receiving a means for initiating an explosive charge which, in the embodiment illustrated, constitutes a conventional shock tube 20. A second end 12*b* is disposed opposite the first end 12*a* and will be discussed in detail below.

Also disposed at the first end 12*a* of the cylindrical void 12 is a closure bushing 24. The bushing 24 surrounds the shock tube 20 to hold the shock tube 20 in place, and also to protect the shock tube surface connector 2 further along within the cylinder 12 from accidental ignition by static charges which might accumulate on the shock tube 20. See, for example, U.S. Pat. No. 3,981,240.

An end of the shock tube 20 within the housing is disposed adjacent to a means for isolating static. In the instant embodiment it is shown as a static isolation cup 28. However, the means for isolating static can be any device suitable for dispersing such a charge. The isolation cup 28 is in contact with side walls of the cylinder 12 and is made of conductive material to conduct static charges away from the shock tube 20 and toward the housing 10.

The next element in sequence within the housing 10 is a transition element 30 which includes a cup or ferrule formed in the shape of a cylinder having a bore 34 in which is placed a reactable material 36 which will burn with a stable intensity in response to an ignition signal from the shock tube 20. As is evident from the drawing, the transition element 30 is placed between the ignition source which, in this case, is the combustion of the shock tube 20 and static isolation cup 28, and a sealer element 40, which leads to a delay train charge 52.

Positioned immediately adjacent to the transition element 30, on a side opposite the isolation cup 28, is a sealer means or sealer element 40. As shown in FIG. 1, the sealer element formed in the shape of a cylinder 42 having a central bore 44 filled with a combustible charge 46 for transferring an ignition signal from the transition element 30 to a delay train charge 52. The sealer element 40 is conventional in design and might, for example, be constructed of lead for the cylinder 42 so that when the combustible charge 46 ignites, the lead melts to seal the bore to prevent gases or vapors from escaping back through the cylinder 12.

A sleeve means is provided for circumscribing a delay means and an output charge which will be discussed in more detail below. As shown in FIG. 1, the sleeve means is a metallic sleeve 50 disposed immediately adjacent to the sealing element 40 and at or near the second end 12*b* of the cylindrical void 12. The sleeve 50 is generally cylindrical and is disposed within the housing such that walls of the cylinder are co-axial with the cylindrical void 12. The length of the sleeve means 50 is preferably between 2 and 10 times as long as the diameter of the sleeve means aperture 50*b*. The sleeve means 50 can be made of virtually any very rigid material, with steel, bronze or aluminum being preferable. The sleeve 50 must be sufficiently strong to withstand and reflect the explosive force from an output charge. A breakage of the sleeve 50 will result in nonuniform dispersion of the output charge's explosive force, which is undesirable.

Located within the sleeve 50 and adjacent to the combustible charge 46 of the sealer element 40 is a delay means or delay train charge for transferring an initiation signal to the output charge. As shown in FIG. 1, the delay means is a conventional delay charge 52. In addition to transferring the initiation signal, the delay charge 52 delays ignition of an output charge 54 for a predetermined period.

The output charge 54 is disposed within the sleeve 50 and is adjacent to the delay charge 52 on a side opposite the sealer element 40. The output charge 54 is composed of a heat sensitive explosive composition. Those skilled in the art will be familiar with many such compounds. Unlike traditional shock tube connectors, an airspace 56 is also disposed within the sleeve 50 and adjacent to the output charge 54 on a side opposite the delay charge 52. Typically, the airspace 56 will be between 5 and 60 percent of the volume of the sleeve 50. By controlling the aperture 50*b* of the sleeve 50 and the length of the airspace 56, an explosive force 80 of the output charge 54 can be controlled as it exits out of the second end 12*b* of the cylindrical void 12. Thus, the explosive force 80 can be tailored to a base charge (not shown) or to a number of shock tubes 70 to be ignited.

Figure 2A:
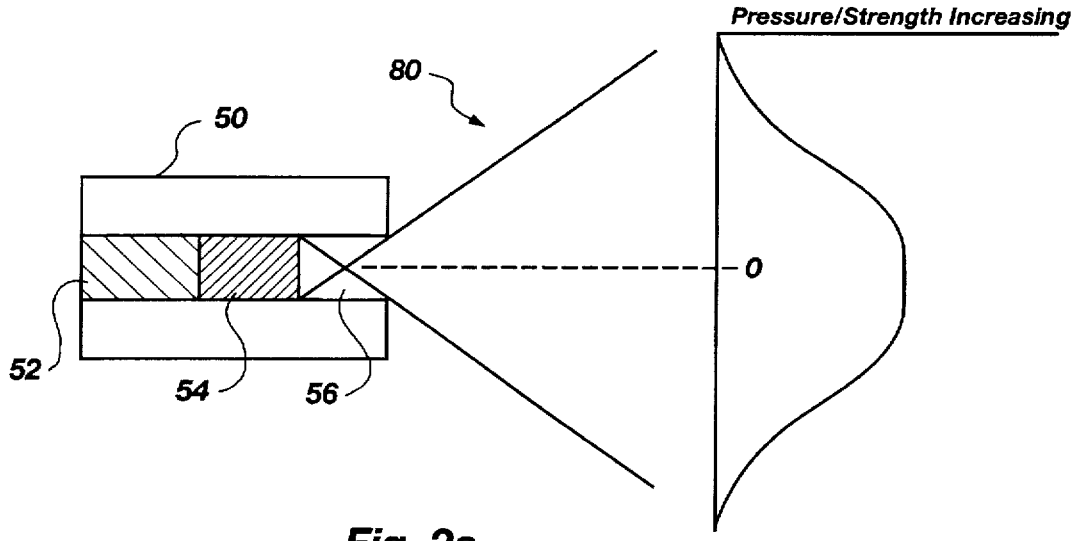
FIGS. 2*a*–2*c* show Gaussian curves for the explosion of the output element with differing lengths of airspace and different apertures of the metallic sleeve.
Figure 2B:
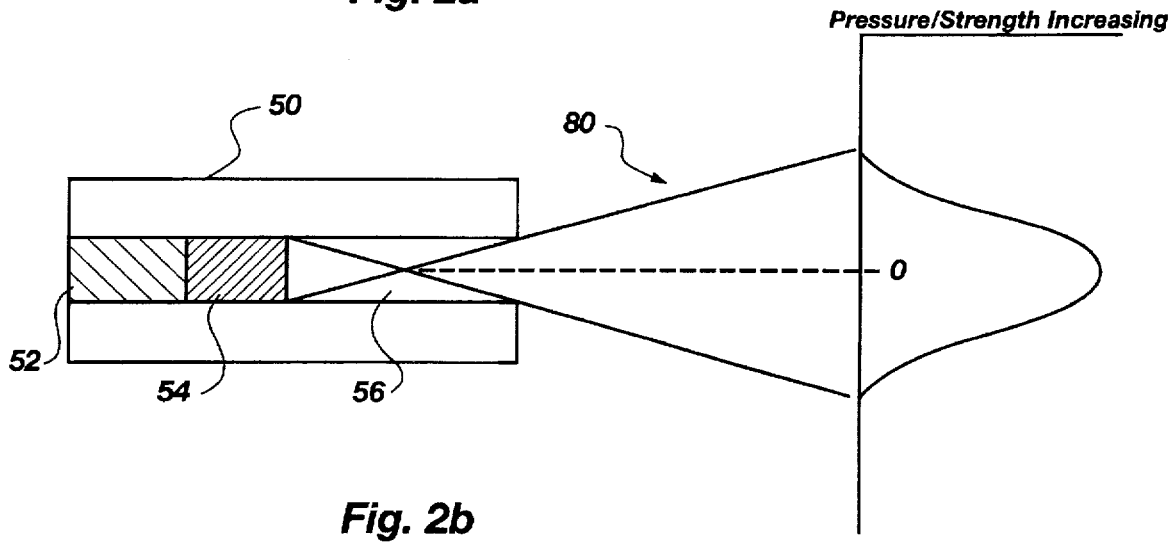
Figure 2C:
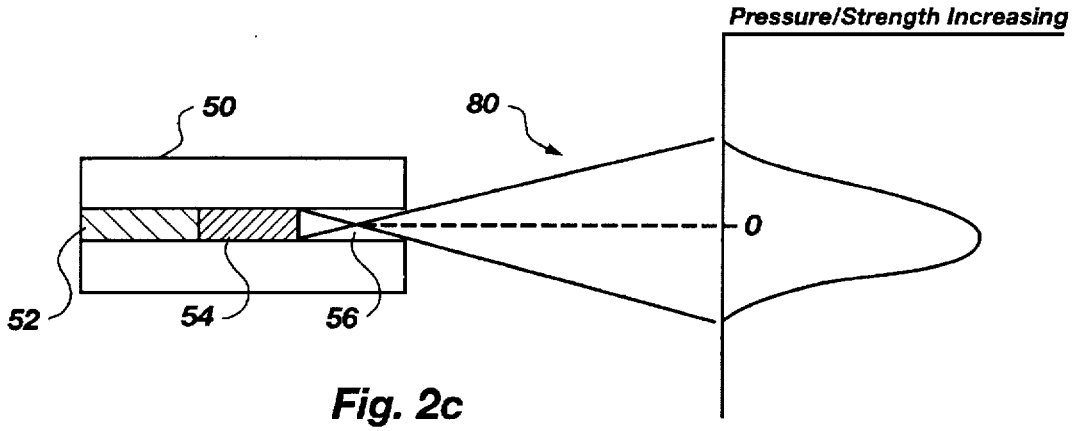

The narrower the aperture 50*b* of the sleeve 50 and the longer the airspace 56, the more restricted the explosive force and the tighter the Gaussian curve. Thus, the invention allows much more accurate control of the dynamics of the explosive force which initiates the shock tubes. FIGS. 2*a* through 2*c* show changes in Gaussian curves resulting from changes in sleeve aperture and/or airspace length.

Figure 3:
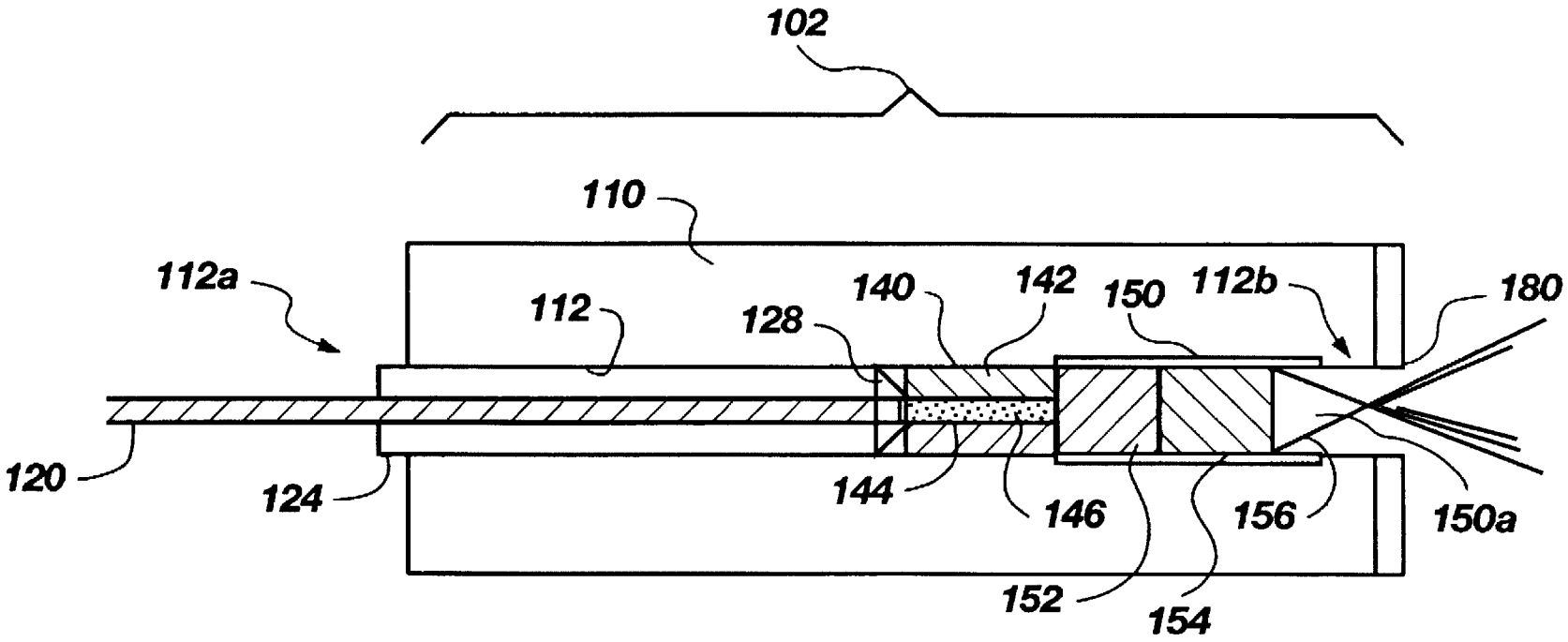
FIG. 3 shows a side cross-sectional view of a second embodiment of the shock tube surface connector.

Referring now to FIG. 3, there is shown a second illustrative embodiment of a shock tube surface connector 102 for transferring an ignition signal to multiple tubes, and made in accordance with the present invention. The connector 102 includes a housing 110 made of plastic or some other durable material. Within the housing 110 is formed an elongate cylindrical void 112 which is open at both ends, a first end 112*a* being open for receiving an ignition source which, in the embodiment illustrated, constitutes a conventional shock tube 120. A second end 112*b* is disposed opposite the first end 112*a* and will be discussed further below.

Also disposed at the first end 112*a* of the cylindrical void 112 is a closure bushing 124. The bushing 124 surrounds the shock tube 120, holding the shock tube 120 in place, and protects the shock tube surface connector 102 further along within the cylinder 112 from accidental ignition by static charges which might accumulate on the shock tube 120. An end of the shock tube 120 within the cylinder 112 is disposed adjacent to a static isolation cup 128. The isolation cup 128 is in contact with side walls of the cylinder 112 and is made of conductive material to conduct static charges away from the shock tube 120 and toward the housing 110.

Positioned between the static isolation cup 128 and before a delay charge 152 is a sealer element 140 formed in the shape of a cylinder and having a central bore 144 filled with a combustible charge 146 for transferring an ignition signal from the static isolation cup 128 to the delay charge 152. The sealer element 140 is conventional in design and might, for example, be constructed of lead so that when the combustible charge 146 ignites, the lead melts to seal the bore to prevent gases or vapors from escaping back through the cylinder 112.

Located within the cylinder 112 and adjacent to the sealer element 140 on a side opposite the static isolation cup 128 is the delay charge 152. The delay charge 152 is provided to delay ignition of an output charge 154 for a predetermined period.

The output charge 154 is disposed within the cylinder 112 and is adjacent to the delay charge 152 on a side opposite the sealer element 140. The output charge 154 is composed of a heat sensitive explosive composition. An airspace 156 is disposed within the cylinder and adjacent to the output charge 154 on a side opposite the delay charge 152. The delay charge 152, the output charge 154 and the airspace 156 are encompassed by a metallic sleeve 150. Once ignited, the output element discharges an explosive force 180. As the explosive force 180 passes through the airspace 156, its radial expansion is limited by the sleeve 150 until it reaches the second end 112*b* of the cylindrical void 112. By controlling the aperture 150*a* of the sleeve 150 and length of the airspace 156, the explosive force 180 of the output charge 154 can be controlled into a desired pattern. The narrower the aperture of the sleeve 150*a* and the longer the airspace 156, the more restricted the explosive force.

Figure 4:
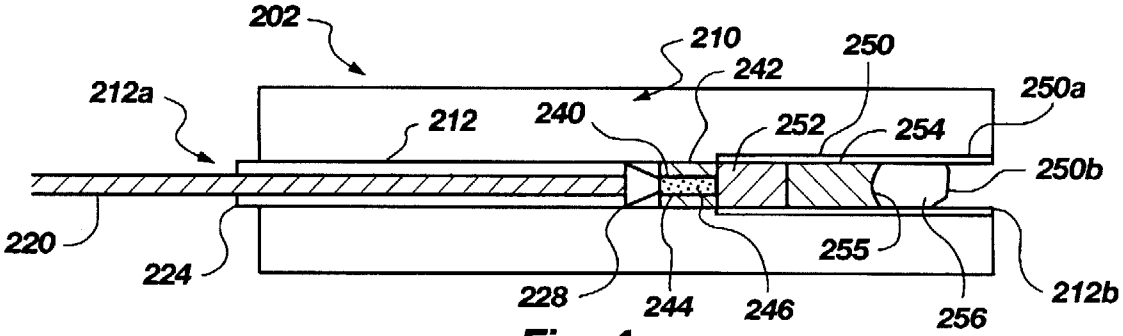
FIG. 4 is a side cross-sectional view of a third embodiment of the instant invention.

FIG. 4 shows a third illustrative embodiment of a shock tube surface connector 202 for transferring an ignition signal to multiple tubes, and made in accordance with the present invention. The connector 202 includes a housing 210 made of plastic or some other durable material. Within the housing 210 is formed an elongate cylindrical void 212 which is open at both ends, a first end 212*a* being open for receiving an ignition source which, in the embodiment illustrated, constitutes a conventional shock tube 220. A second end 212*b* is disposed opposite the first end 212*a* and will be discussed further below.

Also located in the first end 212*a* of the cylindrical void 212 is a closure bushing 224. The bushing 224 surrounds the shock tube 220 to hold the shock tube 220 in place, and also to protect the shock tube surface connector further along within the cylinder 212 from accidental ignition by static charges which might accumulate on the shock tube 220.

An end of the shock tube 220 is disposed adjacent to a static isolation cup 228 and another end extends outside of the cylinder 212 and to an initiation source (not shown). The isolation cup 228 is in contact with side walls of the cylinder 212 and is made of conductive material to conduct static charges away from the shock tube 220 and toward the housing 210.

The next element in sequence within the void 212 is a sealer element 240 formed in the shape of a cylinder having a central bore 244 filled with a combustible charge 246 for transferring an ignition signal to the shock tube 220 and static isolation cup 228, and to a delay charge 252. The sealer element 240 is conventional in design and might, for example, be constructed of lead so that when the combustible charge 246 ignites, the lead melts to seal the bore to prevent gases or vapors from escaping back through the cylinder 212.

A cylindrical sleeve 250 is disposed immediately after the sealing element 240 and extends to the second end 212*b* of the cylindrical void 212. The sleeve 250 is generally cylindrical and can be made of virtually any very rigid material, with steel, bronze or aluminum being preferable. The sleeve must be sufficiently strong to withstand and reflect an explosive force from an output charge 254, as a breakage of the sleeve 250 will result in nonuniform dispersion of the output charge's explosive force, which is undesirable.

Located within the sleeve 250 and adjacent to the combustible charge 246 of the sealer element 240 is a delay charge 252. This delay charge 252 is provided to delay ignition of the output charge 254 for a predetermined period.

The output charge 254 is disposed within the sleeve 250 and is adjacent to the delay charge 252 on a side opposite the sealer element 240. The output charge 254 is composed of a heat sensitive explosive composition. One end of the output charge, indicated at 255 and disposed opposite of a side of the output charge side adjacent to the delay charge 252, can be either flat, concave or convex. An airspace 256 is also disposed within the sleeve 250 and adjacent to the side 255 of the output charge 254 and on a side opposite the delay charge 252. By modifying an interior aperture 250*b* of the sleeve 250 and the length of the airspace 256 (the distance between side 255 of the output charge and an end of the sleeve 250*a*), an explosive force (not shown in FIG. 4) of the output charge 254 can be controlled. Additionally, by providing an output charge 254 with a slightly concave side 255 (as shown in FIGS. 4 and 5), the focal point of the explosion can be directed either within the airspace 256 or at some point beyond the end of the sleeve 250. The greater the curvature of the side 255, the closer the focal point will be. Thus, by modifying the length of the airspace 256 (the distance between side 255 of the output charge and an end of the sleeve 250*a*), the interior aperture 250*b* of the sleeve 250, and the shape of the output charge 254, the explosive force (not shown) can be tailored to the number of shock tubes 270 to be ignited, as well as their position (such as the linear arrangement of FIGS. 5 and 6). Most advantageously, the invention allows for the ignition of several shock tubes in a linear pattern along the axis of the explosive force.

Figure 5A:
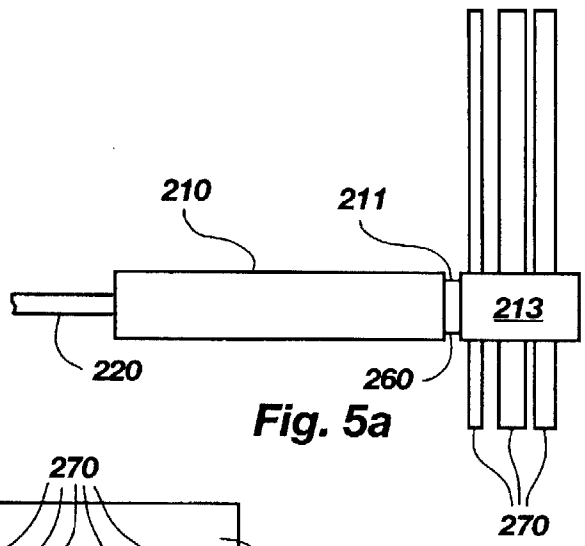
FIG. 5*a* shows a top view of the third embodiment with a plurality of shock tubes in a linear sequence at a right angle to the output explosion.
Figure 5:
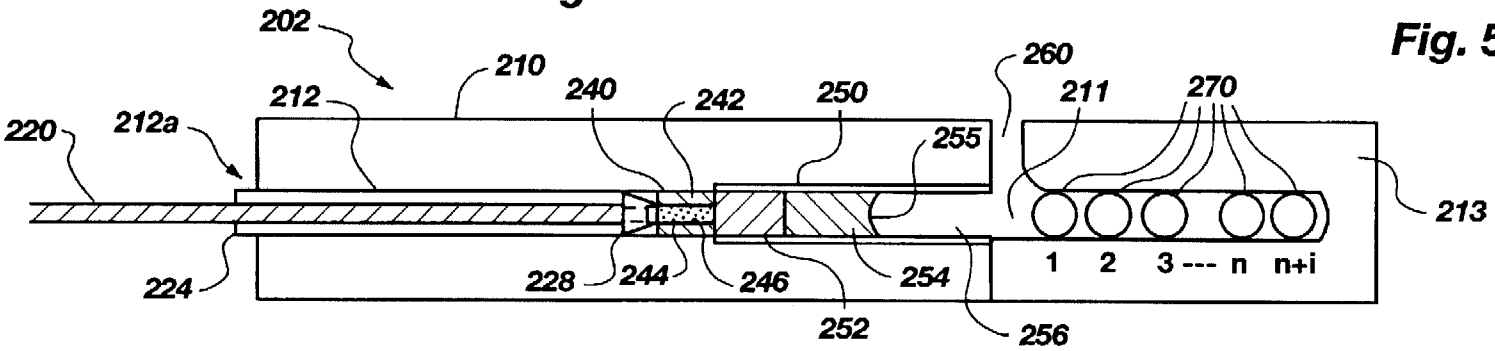
FIG. 5 shows a side cross-sectional view of the third embodiment of a shock tube surface connector having a channel for placing several tubes in a linear sequence at a right angle to the output explosion.

FIGS. 5 and 5*a* show a shock tube surface connector 202 as shown in FIG. 4 in which a number of shock tubes 270 are held in a linear pattern beyond the airspace 256. A section of the tubes 270 is placed within a linear shock tube initiation channel 211 formed by a housing 213. The tube 270 is placed within the channel 211 by sliding the section of the tube through opening 260. The number of tubes 270 held will depend on the size of the housing 213, the strength of the output charge 254 and the number of tubes required to connect the desired number of explosive charges.

Figure 6:
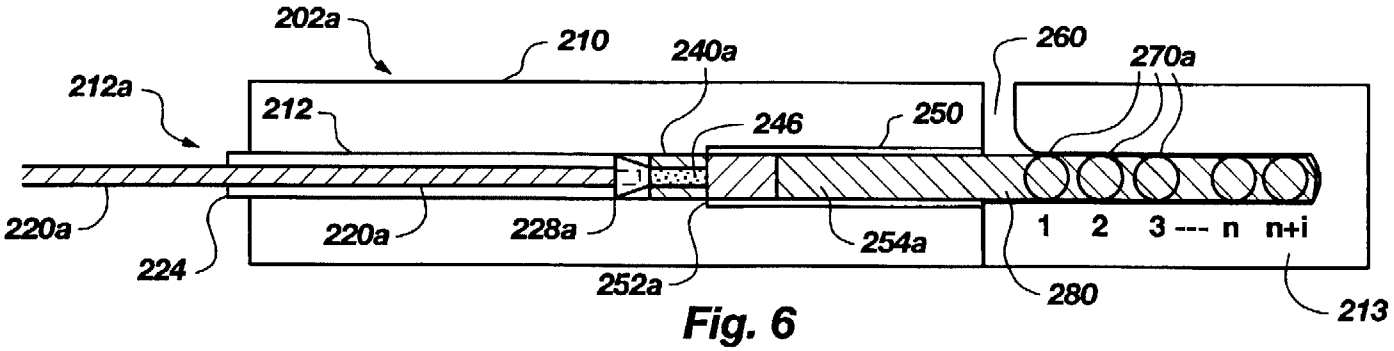
FIG. 6 is a side cross-sectional view of the third embodiment of the invention, as shown in FIG. 5, in which the shock tube surface connector has been ignited.

FIG. 6 shows a shock tube surface connector 202*a* as described with regard to FIGS. 4 and 5 in which the shock tube 220*a* has been ignited, the ignition signal having passed through the static isolation cup 228*a* and through the sealer element 240*a*, having burned the combustible charge 246 and liquified the lead cylinder 242 (shown in FIG. 5). The delay charge 252*a*, having been ignited by the sealer element 240*a*, ignited the output charge 254*a* and caused an explosive force 280. The explosive force was channeled by the sleeve (not shown) and ignited the shock tubes 270*a* in a linear pattern.

Figure 7:
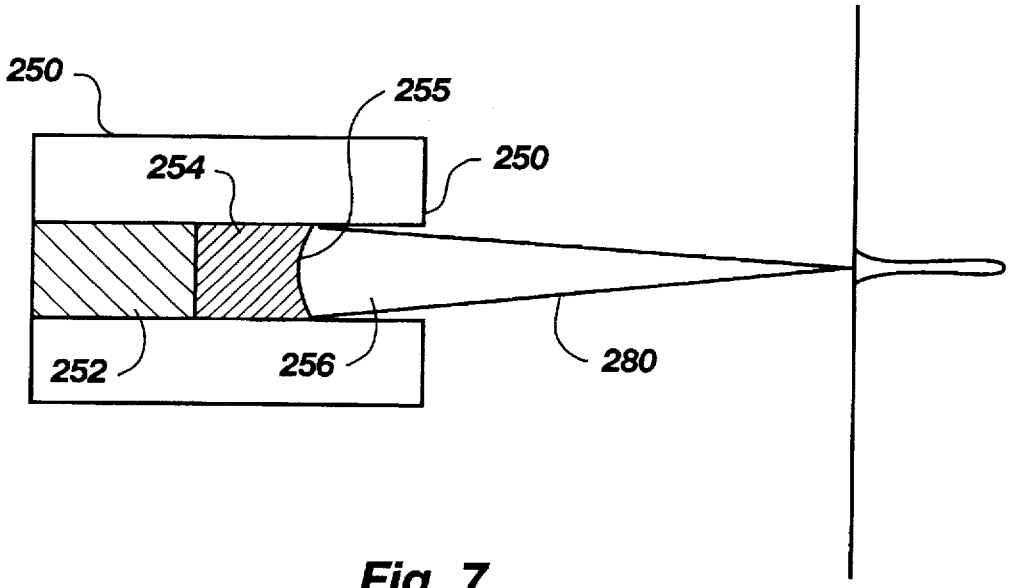
FIG. 7 shows a Gaussian curve for the explosion of the output element of the third embodiment of the invention in which the focal point is well beyond an end of a sleeve containing the output element.
Figure 8:
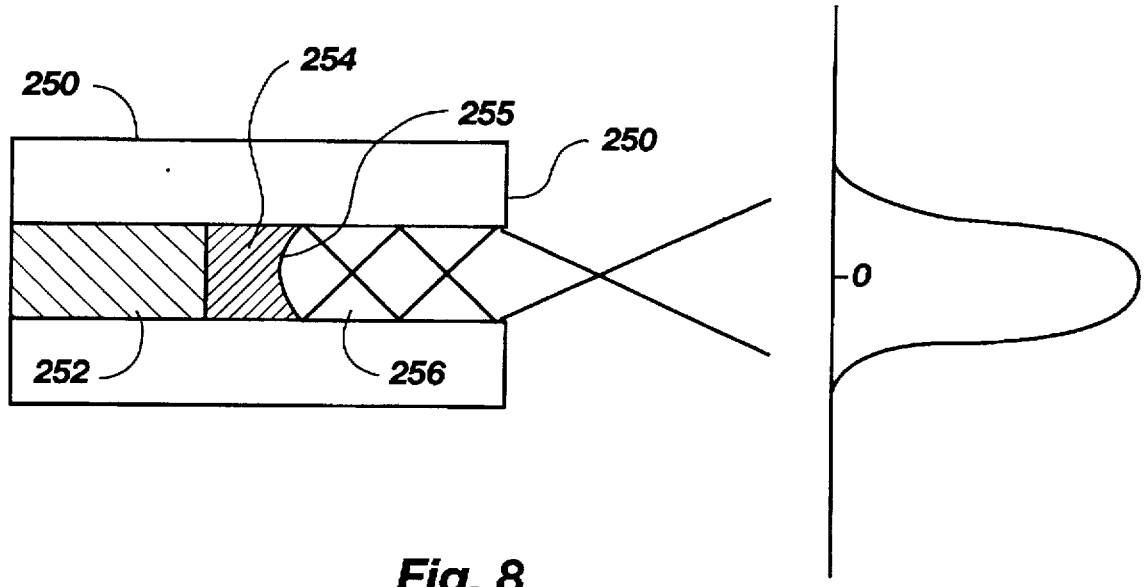
FIG. 8 shows a Gaussian curve for the explosion of the output element of the third embodiment of the invention in which the focal point is inside of the sleeve containing the output element.

FIGS. 7 and 8 show Gaussian curves for the explosive force as used in the third embodiment in which the side 255 of the output charge 254 is concave.

While not shown above, conventional connectors have a metallic shell which encloses the part of the ignition source, the static isolation cup, the sealer element and the sleeve. Such a shell can be used with the invention. The invention, however, eliminates the need for such a shell due to the relatively complete enclosure by the housing 10, 110, and 210. Due to the lack of a metal shell, however, static charges may build and cause an accidental ignition of the output charge. To protect from static, a seal could be disposed on either end of the fuse/output elements. The seal would typically be made of a conductive foil or an ultrasonic welded foil. The foil seal creates an environmental barrier between the powder and the ambient moisture, in addition to protecting the powder and sleeve from static electricity developed on the tube.

Figure 9:
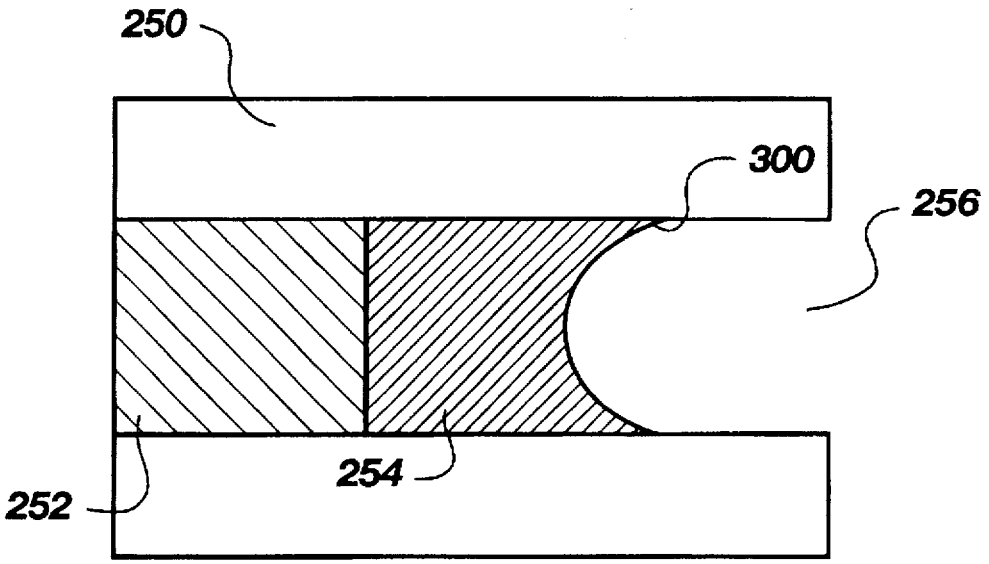
FIG. 9 shows a fragmented side cross-sectional view of a shaped output element having a retention cup positioned thereon.

Referring now to FIG. 9, there is shown a fragmented longitudinal cross-sectional view of the delay charge 252, the output charge 254, the air space 256 and the sleeve 250, similar to that shown in FIG. 8 and identified accordingly. A retention cup 300 is positioned against the output charge 254. The retention cup 300 is usually made of metal, such as copper, bronze or aluminum, and results in a greater jet. Thus, the retention cup acts like a liner used for the conventional type of shaped charges. In addition to the increased jet, the retention cup 300 also provides improved structural integrity. The retention cup 300 reduces chipping and combats the effects of vibration and thermal shock. Furthermore, the retention cup 300 can be used to dictate the shape of the charge—as opposed to using a press pin.

Figure 10:
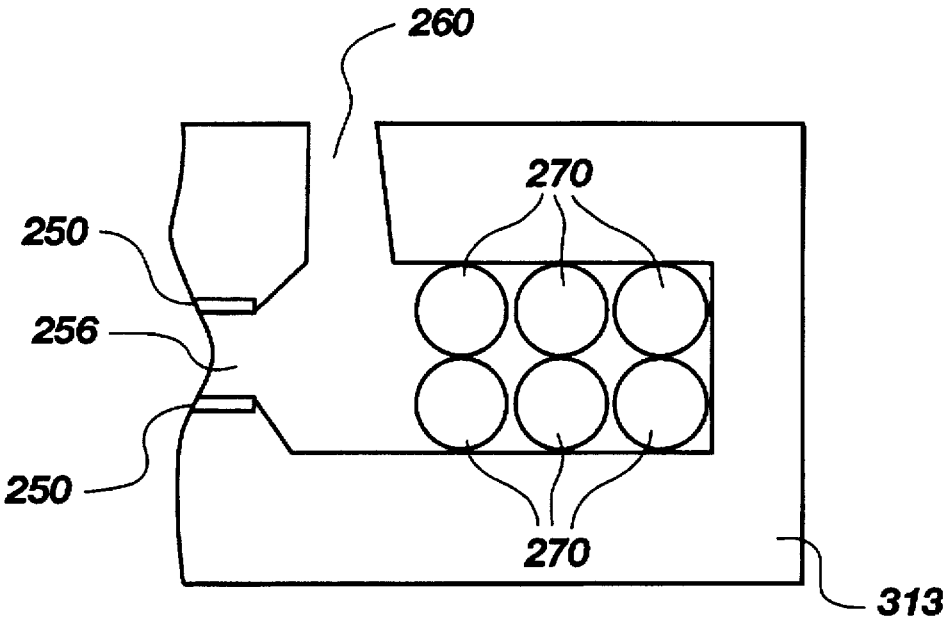
FIG. 10 shows a plurality of shock tubes held in a matrix configuration in the shock tube surface connector.

Referring now to FIG. 10, there is shown a fragmented side cross-sectional view of an alternate manner of arranging the shock tubes. In addition to the linear sequence of the shock tubes 270 within the housing 213 (shown in FIG. 5), the present invention allows the shock tubes to be slid through the opening 260 and arranged in stacked linear rows, such as the 2×3 matrix shown in FIG. 10. Due to the directing of the blast described above, both rows of shock tubes 270 can be positioned within a housing 313 and nearly simultaneously initiated.

In the manner described above, a simple effective shock tube surface connector is provided. The system allows for better control of the explosive force of an output charge, allowing for ignition of shock tubes in a generally linear or matrix pattern. It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications.

What is claimed is:

1. A shock tube surface connector for transferring an ignition signal to one or more shock tubes comprising:

(a) a housing forming an elongate cylindrical void containing open first and second ends, (b) initiation means for igniting a charge, the ignition means being at least partly disposed within the elongate cylindrical void, (c) means for isolating static charges disposed within the cylindrical void and adjacent to the ignition means, (d) sealer means disposed in the cylindrical void on a side of the static isolation means opposite the ignition means, the sealer means comprising a combustible charge for transferring an ignition signal from the initiation means to a delay means, (e) delay means for transferring an initiation signal from the sealer means to an output charge, the delay means being within the cylindrical void and adjacent to the sealer element, (f) an output charge positioned within the cylindrical void adjacent to the delay means and opposite the sealer means, the output charge comprising a heat sensitive explosive composition, (g) sleeve means for circumscribing the delay means and the output charge, the sleeve means being disposed within the cylindrical void adjacent to the sealer means, and (h) an airspace disposed within the sleeve means adjacent to the output charge on a side opposite the delay means and near the second end of the housing cylinder such that the sleeve means confines radial expansion of an explosive force created by ignition of the output charge while the explosive force is within the airspace.

2. The shock tube surface connector of claim 1 further comprising a transition element disposed between the static isolation means and the sealer means, the transition element comprising a cylinder positioned parallel with the elongate cylindrical void, having a bore in which is placed a reactable material for maintaining a stable burning intensity.

3. The shock tube surface connector of claim 1 wherein the airspace occupies between about 5% and 60% of a volume defined within the sleeve means.

4. The shock tube surface connector of claim 3 wherein the sleeve means comprises a metallic sleeve.

5. The shock tube connector of claim 4 wherein the output charge comprises a first side adjacent to the delay train charge and a second side adjacent to the airspace and wherein the second side of the output charge is curved.

6. The shock tube connector of claim 5 wherein the curved second side of the output charge is concave.

7. The shock tube surface connector of claim 6 further comprising a retention cap disposed adjacent the second side of the output charge.

8. The shock tube connector of claim 6 wherein the concave second side of the output charge is of a slight curvature to thereby create an explosive force with a focal point which is beyond the airspace and beyond the second end of the elongate cylindrical void.

9. The shock tube surface connector of claim 8 further comprising a linear shock tube initiation channel, disposed adjacent to the airspace opposite the output charge and co-axial with the elongate cylindrical void, for holding one or more shock tubes in linear disposition and transverse to an explosive force created by ignition of the output charge.

10. The shock tube connector of claim 6 wherein the concave second side of the output charge is of a curvature sufficient to thereby create an explosive force with a focal point which is within the airspace disposed within the metallic sleeve.

11. The shock tube surface connector of claim 10 further comprising a linear shock tube initiation channel, disposed adjacent to the airspace opposite the output charge and co-axial with the elongate cylindrical void, for holding one or more shock tubes in linear disposition and at a right angle to the elongate cylindrical void.

12. The shock tube surface connector of claim 1 wherein the sleeve means comprises an interior aperture and a length, the length being between 2 and 10 times as long as a diameter of the aperture.

13. The shock tube surface connector of claim 1 further comprising a linear shock tube initiation channel disposed adjacent to the airspace, opposite the output charge and co-axial with the elongate cylindrical void, for holding one or more shock tubes in linear disposition and transverse to an explosive force created by ignition of the output charge.

14. A shock tube surface connector for transferring an ignition signal to one or more shock tubes comprising:

(a) a housing forming an elongate cylindrical void containing open first and second ends, (b) an ignition source having a first and second end, the first end being disposed in the elongate cylindrical void and a second end extending out of the first end of the elongate cylindrical void, (c) a static isolation cup disposed within the housing cylinder, at the first end of the ignition source, (d) a transition element disposed adjacent to the static isolation cup on a side opposite the ignition source, the transition element comprising a cylinder positioned parallel with the cylindrical void, having a bore in which is placed a reactable material, (e) a sealer element disposed in the cylindrical void, on a side of the transition element opposite the static isolation cup, the sealer element comprising a combustible charge for transferring an ignition signal to a delay train charge, (f) a metallic sleeve forming a cylindrical void, disposed adjacent to the sealer element on a side opposite the static isolation cup, (g) a delay train charge disposed adjacent to the sealer element and within the metallic sleeve, the delay train charge comprising an exothermic-burning composition, (h) an output charge located within the metallic sleeve and adjacent to the delay train charge, the output charge comprising a heat sensitive explosive composition, (i) an airspace disposed adjacent to the output charge, within the metallic sleeve, and near the second end of the housing cylinder, and (j) a shock tube initiation channel disposed adjacent to the airspace, opposite the output charge and co-axial with the elongate cylindrical void, for holding one or more shock tubes in disposition transverse to an explosive force created by ignition of the output charge.

15. The shock tube surface connector of claim 14 wherein a shaped retention cup is disposed between the output charge and the airspace.

16. The shock tube surface connector of claim 14 wherein the shock tube initiation channel is generally linear and of a width such that shock tubes may only be placed in the channel in a linear row.

17. The shock tube surface connector of claim 14 wherein the shock tube initiation channel is sufficiently wide such that shock tubes may be passed through the channel in more than one linear row.

18. A method for initiating one or more shock tubes in a linear sequence by the use of a shock tube surface connector having a housing with a cylindrical void with open first and second ends, an ignition means disposed at least partially within the first end of cylindrical void, a means for dispersing static isolation disposed within the void and adjacent to the ignition means, a delay means for transferring an ignition signal to an output charge, an output charge and a sleeve means for circumscribing the delay means and the output charge, the method comprising the steps of:

(a) providing an airspace disposed adjacent to the output charge, within the sleeve meads, and near the second end of the housing cylinder, (b) positioning at least one shock tube adjacent the second end of the housing cylinder, and (c) causing an initiation signal to be conveyed through the ignition means and delay means, thereby causing the output charge to explode and an explosive force to be directed by the sleeve means out of the second end of the elongate cylindrical void and into at least one shock tube.

19. The method of claim 18 further comprising providing a linear shock tube initiation channel disposed at the open second end of the elongate cylindrical void, the channel holding one or more shock tubes in linear sequence at a right angle to the direction of the explosive force.

20. The method of claim 19 further comprising placing more than one shock tubes within the shock tube initiation channel and in a linear pattern co-axial with the elongate cylindrical void.

21. The method of claim 20 wherein the explosive force is directed into the shock tube initialization channel, initiating the shock tubes in a linear sequence.

22. The method of claim 18 further comprising using a delay train charge as the delay means, and providing an output charge comprising a first side adjacent to the delay train charge and a second side adjacent to the airspace, wherein said second side is concave.

23. The method of claim 22 further comprising shaping the second side of the output charge to have a focal point for the explosive force within the airspace.

24. The method of claim 22 further comprising using a metal sleeve as the sleeve means, and shaping the concave second side of the output charge so that the second side has an explosive focal point beyond the metal sleeve and beyond the open second end of the elongate cylindrical void.

25. The method of claim 22 further comprising forming the concave second side by pressing the output charge with a concave retention cap.

26. The method of claim 18 further comprising providing an output charge comprising a first side adjacent to the delay train charge and a second side adjacent to the airspace, wherein said second side is convex.

27. A method for initiating one or more shock tubes in a linear sequence, the method comprising the steps of:

(a) providing a housing forming an elongate cylindrical void having open first and second ends, (b) providing an ignition source having a first and second end, the first end being disposed in the elongate cylindrical void and a second end extending out of the first end of the elongate cylindrical void, (c) providing a sealer element disposed in the housing cylinder on a side of a static isolation cup opposite the ignition source, the sealer element comprising a combustible charge for transferring an ignition signal to a delay train charge, (d) placing a metallic sleeve forming a cylindrical void adjacent to the sealer element on a side opposite the static isolation cup, (e) locating a delay train charge adjacent to the sealer element and within the metallic sleeve, the delay train charge comprising an exothermic-burning composition, (f) placing an output charge located within the metallic sleeve and adjacent to the delay train charge, the output charge comprising a heat sensitive explosive composition, (g) positioning an airspace adjacent to the output charge, within the metallic sleeve, and near a second end of the housing cylinder, (h) positioning a shock tube coupling channel at the open second end of the elongate cylindrical void, the channel holding one or more shock tubes in linear sequence transverse to an explosive force created by ignition of the output charge, and (i) causing an initiation signal to be conveyed in the shock tube, thereby causing the output charge to explode and an explosive force to be directed by the metallic sleeve out of the second end of the elongate cylindrical void and into a shock tube initiation channel.

28. The method of claim 27 wherein step (g) further comprises positioning a retention cup between the output charge and the airspace.

* * * * *